US006006839A

United States Patent [19]

Dearing et al.

[11] Patent Number: 6,006,839

[45] Date of Patent: Dec. 28, 1999

[54] PRESSURIZED FLEXIBLE CONDUIT INJECTION SYSTEM

[75] Inventors: Michael Patrick Dearing, Cypress; Michael Lee Smith, Banquette, both of Tex.

[73] Assignee: Stewart & Stevenson, Inc., Houston, Tex.

[21] Appl. No.: 08/720,651

[22] Filed: Oct. 2, 1996

[51] Int. Cl.[6] ..... E21B 19/22

[52] U.S. Cl. ..... 166/384; 166/77.2; 166/85.5

[58] Field of Search ..... 166/77.3, 77.2, 166/77.1, 384, 379, 85.5, 385, 84.1, 84.2, 84.4

[56] References Cited

U.S. PATENT DOCUMENTS

| | | | |
|---|---|---|---|
| 2,677,427 | 5/1954 | McKinney et al. | 166/77.1 |
| 2,810,442 | 10/1957 | Taush | 166/77.2 |
| 3,145,995 | 8/1964 | Adamson et al. | 166/84.1 |
| 3,212,581 | 10/1965 | Marshall | 166/84.2 |
| 3,346,045 | 10/1967 | Knapp et al. | 166/350 |
| 3,363,880 | 1/1968 | Blagg | 166/77.3 |
| 3,866,679 | 2/1975 | Laky | 166/77.3 |
| 3,920,076 | 11/1975 | Laky | 166/384 |
| 4,091,867 | 5/1978 | Shannon, Jr. et al. | 166/77.3 |

*Primary Examiner*—Hoang C. Dang
*Attorney, Agent, or Firm*—Sue Z. Shaper; Butler & Binion, L.L.P.

[57] ABSTRACT

A guide system for injecting continuous conduit or tubing into a well under pressure including a closed pressurized chamber for equalizing the interior and exterior pressure on the conduit in the area where the conduit is under maximum stress due to bending or flexing. The chamber may be installed on a standard wellhead or injection head. Low friction guide sleeves are provided as a bearing surface for the conduit in the pressurized chamber.

38 Claims, 2 Drawing Sheets

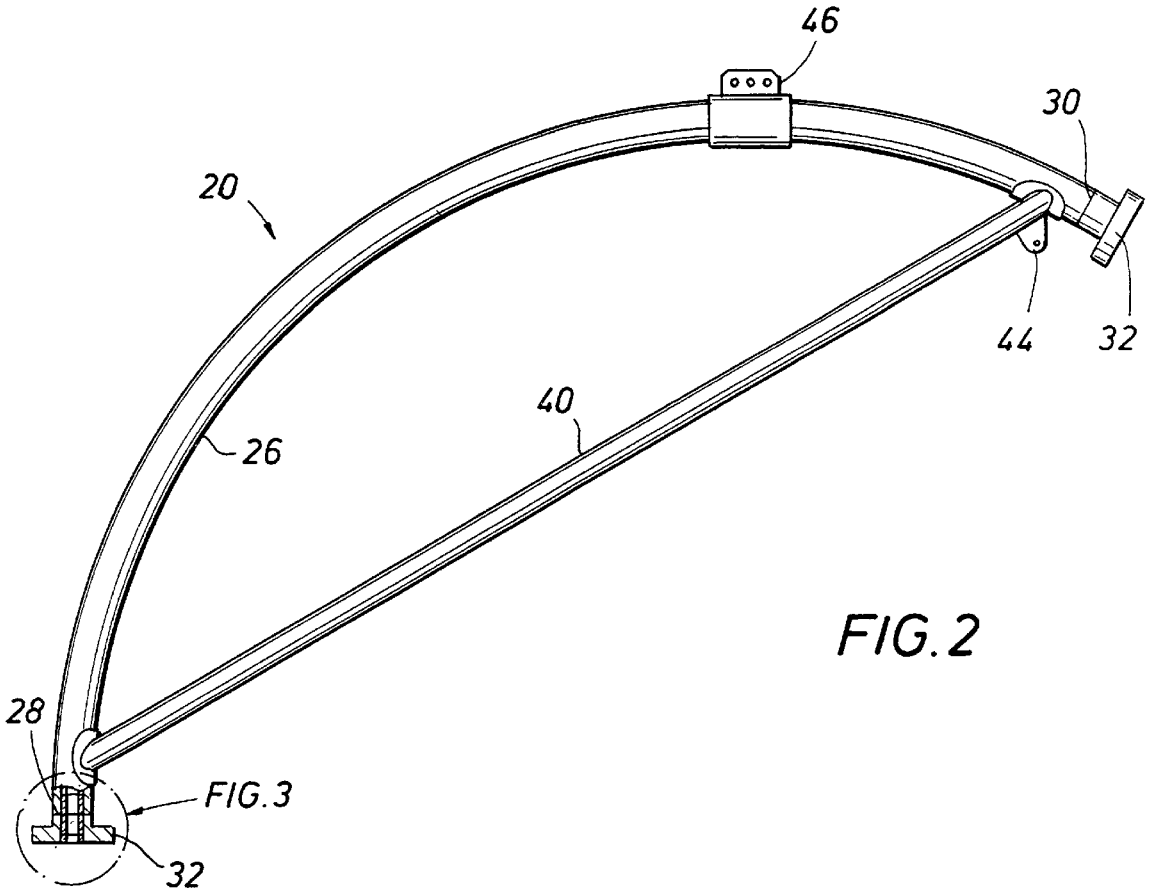
FIG. 2
FIG. 3
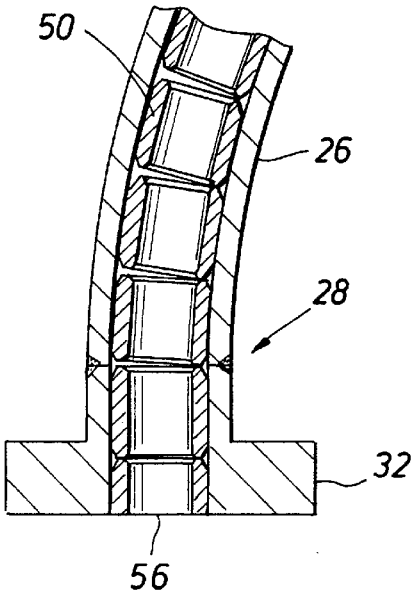
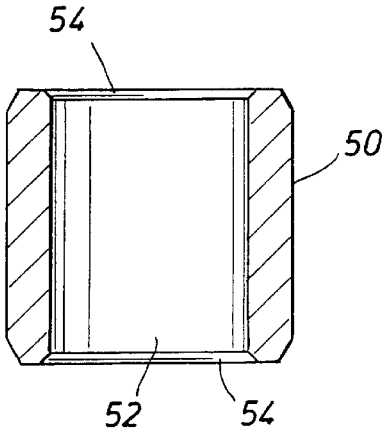
FIG. 4

PRESSURIZED FLEXIBLE CONDUIT INJECTION SYSTEM

BACKGROUND OF INVENTION

1. Field of Invention

The subject invention is generally related to a system for injecting continuous flexible conduit or pipe into a well against the pressure of the well and is specifically directed to an apparatus and method for pressurizing the exterior wall of the conduit as it is flexed to enter the well.

2. Discussion of the Prior Art

Apparatus for feeding continuous tubing or conduit into a well are well known. An example of such a system is shown and described in U.S. Pat. No. 4,091,867, entitled: "Flexible Conduit Injection System", issued to F. E. Shannon et al, on May 30, 1978. As there shown, the well typically includes a Christmas tree above the opening with a blow-out preventer at the top or outermost opening. A connector is attached to the blow-out preventer for receiving and feeding the flexible conduit into and out of the well casing. The conduit is fed from a spool located at a distance from the well. As the conduit is paid out from the spool, it is flexed around a guide member to direct the conduit into the connector and into the well.

The conduit is typically under well pressure during this operation. At the area where the conduit is flexed around the guide path member the wall stresses are greatly increased, particularly due to the pressure difference between the internal and external walls of the conduit. This added stress greatly contributes to reducing the life of the conduit.

A number of different methods and systems for bending or flexing the conduit have been developed in order to minimize the pressure induced stress at the points of maximum flex. Most have attempted to resolve the problem by minimizing the amount of flex or bending to which the conduit is subjected. U.S. Pat. No. 3,920,076, entitled: "Method for Inserting Flexible Pipe into Wells", issued to T. Laky on Nov. 18, 1975 utilizes a rotating capstan to maintain a tangential support of the pipe as it enters the well.

The aforementioned U.S. Pat. No. 4,091,867 provides for a closed guide member in fluid communication with the connector at the blow-out preventer and an injector drive means to maintain the conduit exterior under well pressure during the injection or withdrawal function. Rollers are provided in the interior of the guide means to minimize friction as the conduit is fed therethrough. While this apparatus includes the advantage of reducing the differential pressure on the conduit, and thereby minimizing the wall stress particularly at points of maximum stress, the device disclosed in the '867 patent has not gained widespread acceptance. In order to provide the external pressure equalization of the conduit at the point of maximum flex, it is necessary to provide a closed pressure chamber from the spool injector head to the blow-out preventer connector. This has proven to be a cumbersome apparatus with the improved results not worth the effort. Further, the rollers provided in the curved guide member proved to be both complicated and somewhat unreliable, with a substantial number of moving parts required to be maintained in good working order while the conduit is moved through the system.

While the advantages of maintaining reduced differential pressure on the interior and exterior walls of the conduit are well recognized as a viable means for reducing fatigue in the highest stressed areas, a reliable functional means for achieving this has not previously been available.

SUMMARY OF THE INVENTION

The subject invention is specifically directed to an improved method and apparatus for equalizing the pressure in the inside and outside walls of a flexible pipe or conduit at the point of maximum stress as it is flexed and bent around a guide member to be directed into a wellhead. In the preferred embodiment of the invention, the conduit is passed through a closed chamber which forms the curved guide member for bending the pipe to direct it into the well connector. Only that portion of the conduit which is in the guide chamber is under equalized pressure. This greatly simplifies the apparatus for pressurizing the external wall of the conduit and also preserves the basic injection operation. Specifically, the conduit may be fed into the guide chamber from either end without dismantling any portion of the injector head or the wellhead connector system. Further, the conduit entering the chamber and exiting the chamber is visible at all times, giving better visual indication of the success of the operation. In the preferred embodiment of the invention, the guide member comprises a chamber of cylindrical cross-section, typically a tubular member, curved to form a radius for bending the conduit to redirect the conduit from the payout point of the spool to the wellhead connector at the blow-out preventer. A sealing flange is provided at both open ends of the chamber for sealing around the perimeter of the conduit as it enters and exits the chamber. The chamber is then pressurized by a separate pump system or with well pressure to equalize the pressure on the external side wall of the conduit with the pressure in the conduit. This equalization reduces the wall stress as the conduit is flexed and bent by the guide member as it is injected into the well.

In the preferred embodiment, a series of cylindrical, hollow sleeves are place end-to-end along the length of the interior of the guide member chamber. The sleeves have a low-friction interior surface for receiving the conduit as it advances through the chamber. The sleeves provide three important functions: 1. Reduce the volume of the chamber to facilitate pressurization; 2. Provide a low-friction bearing surface for supporting the conduit in the chamber as it is advanced therethrough; and 3. Provide full arch support of the tubing to assure smooth bending of the conduit as it advances through the chamber, further reducing the stress on the sidewall of the conduit.

In the preferred embodiment, the guide sleeves are formed of a high strength, low friction resin such as, by way of example, HMW polyethylene. The guide chamber is constructed from a continuous, seamless 4140 steel tube heat treated to 100 KSI yield.

The pressurized guide member system of the subject invention is adapted to be inserted between the wellhead or injector head stripper and the spool without requiring any alteration of the wellhead, injector head or spool apparatus. Standard strippers are utilized to provide the sealing flanges at either end of the guide chamber. The gauge port in one of the strippers is utilized for pressurizing the chamber.

It is, therefore, and object and feature of the subject invention to provide a system for guiding flexible tubing or pipe into a wellhead from a payout spool while reducing the differential pressure on the interior and exterior side walls of the pipe at the areas of maximum bending stress.

It is another object and feature of the subject invention to provide a pressurized guide chamber which can be incorporated in the conduit injection system with a minimum of alteration to existing wellhead, spool and injector head components.

It is a further object and feature of the subject invention to provide a guide sleeve for guiding the conduit through the guide chamber utilizing a minimum of moving parts.

It is an additional object and feature of the invention to provide a composite, low-friction guide sleeve providing full arch support of the conduit in the guide chamber.

Other objects and features of the invention will be apparent from the drawings and detailed description of the invention which follows.

BRIEF DESCRIPTION OF THE DRAWINGS

FIG. 2 is a view looking in the same direction as FIG. 1 showing the guide chamber assembly.

FIG. 3 shows a portion of the guide chamber tube in longitudinal cross section, with the guide sleeves in position therein.

FIG. 4 is a longitudinal cross section of a guide sleeve.

DETAILED DESCRIPTION OF THE PREFERRED EMBODIMENT

Figure 1:
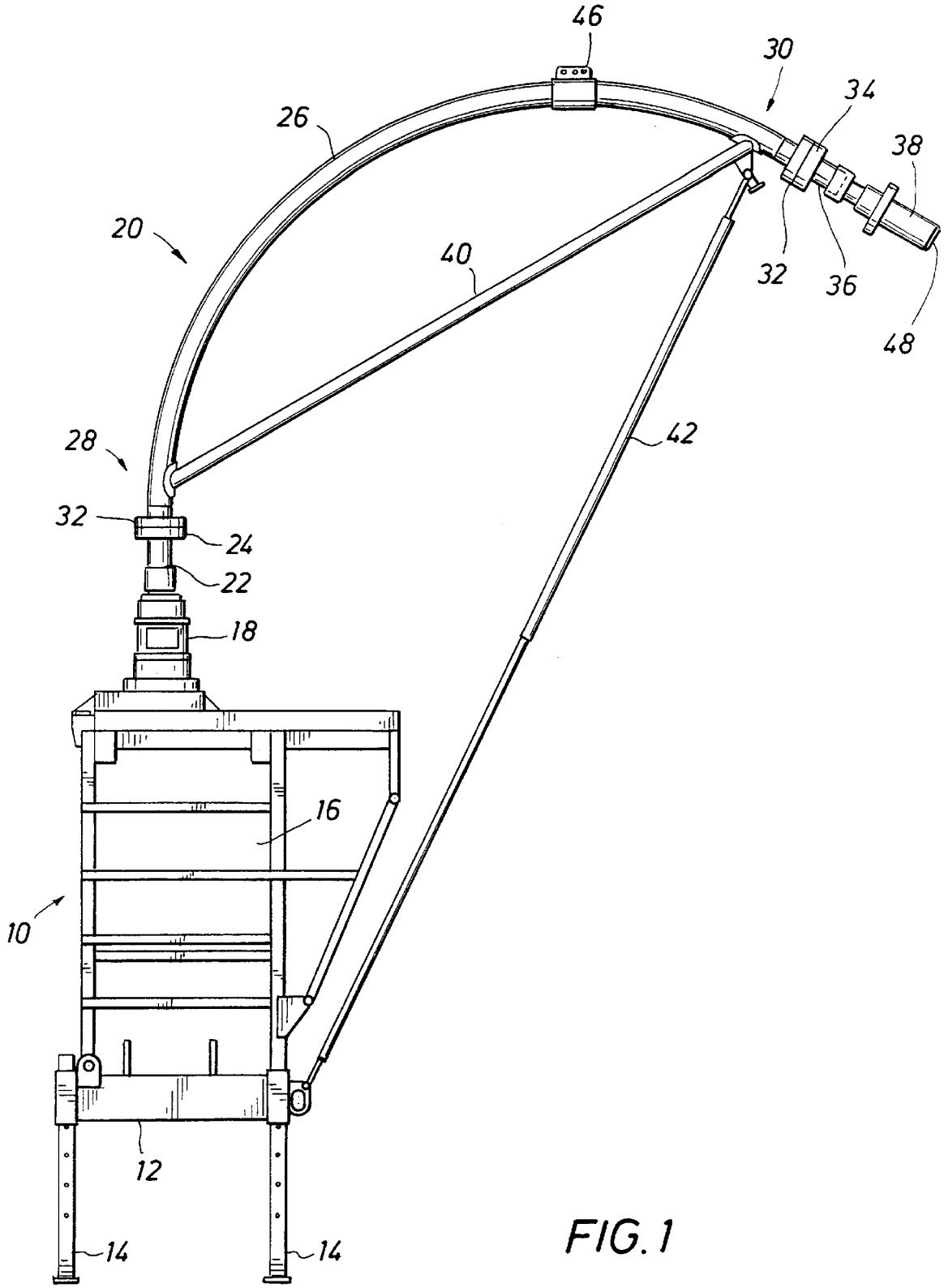
FIG. 1 is a plan view of a wellhead assembly incorporating the pressurized guide chamber of the subject invention.

A guide member/injector head apparatus including the pressurized guide member system of the subject invention is shown in FIG. 1. The injector head 10 includes a mounting flange 12 which is adapted to be mounted on the stripper above the wellhead blow-out preventer (not shown). Adjustable support legs 14 are provided to stabilize the pressurized guide member system relative to the injector head. The conduit passes through the injector head 16. A stripper 18 is mounted on the top of the injector head, through which the conduit passes, in typical fashion.

The pressurized guide chamber system 20 of the subject invention is mounted above the injector head 16. In the preferred embodiment, a union adapter 22 is mounted on the stripper 18. The union adapter includes a flange 24 to which the lower end of the guide member is mounted. The injector head 10 is not required to be altered in order to accommodate the pressurized guide chamber system 20 of the subject invention.

As shown in FIGS. 1 and 2, the guide chamber system includes an elongated, cylindrical hollow tube 26 having open outer ends 28 and 30. The tube is bent along a suitable radius to provide a guide path for bending a flexible conduit around a path for directing it from a standard payout spool into the injector head 10. In the preferred embodiment, the tube 26 is constructed of seamless 4140 steel heat treated to 100 KSI minimum yield. Typically, the tube is of an outer diameter of 5.00 inches with an inner diameter of 3.50 inches. Of course the size of the tube can vary depending on the range of sizes of conduit to be injected into the well.

A flange 32 is mounted on each of the open ends 28 and 30 of the tube. The flange on end 28 is then secured to the mated flange 24 above the injector head. Typically, a sealing gasket is placed between the flanges in the well known manner. The flange at end 30 of the tube is secured to a mated flange 34 on a union adapter 36 which is secured to a stripper 38.

A cross brace 40 is provided to stabilize the tube 26. An adjustable support leg 42 is provided for supporting the outer end 30 of the tube directly on the injector head assembly. As better shown in FIG. 2, an eye bracket 44 may be provided for pivotally mounting the support leg. A lifting bracket or fixture 46 is secured to the outer perimeter of the tube 26 to facilitate assemble of the guide chamber system on the injector head.

In operation, flexible conduit, not shown, is fed from the spool (not shown) into the open end 48 of the stripper 38 and into the guide tube 26. The gauge port on either of the strippers 18 or 38 is used to connect a pressure line from a pressure pump system (not shown) or from the well in order to place the chamber under pressure to bring the pressure to nearly equal that of the well. This reduces the pressure differential between the exterior and interior of the conduit throughout the entire length of the guide tube 26. The conduit exits the guide tube at the flange 32 on end 28 of the tube and enters the injector head 10.

A longitudinal cross section of the tube 26 is shown in FIG. 3. Guide sleeves 50 are positioned in end-to-end relationship throughout the length of the tube. In the preferred embodiment, the guide sleeves are formed of a high strength, low friction resin such as HMW polyethylene.

Using a tube with a 3.50 inch inner diameter as an example, the outer diameter of the sleeve is 3.25 inch and each sleeve is 3.00 inches in length. The inside diameter of the sleeve is 0.25 inches larger than the outer diameter of the conduit. Each end of the sleeve is internally chamfered on a 0.25 inch radius (see FIG. 4) to provide a smooth transition surface between sleeves to enhance gliding of the conduit through the system. In the preferred embodiment, the last sleeve in the series is cut and chamfered to fit at 56 (see FIG. 3) at the outer end of the flange 32.

It has been found that the pressurized guide system of the present invention provides an excellent method and apparatus for guiding a conduit around a bending path while reducing the stress on the conduit by reducing the differential pressure. The system can be incorporated in a typical wellhead installation with a minimum of alteration. The sleeves, in particular, smooth out the bending action on the conduit and further relieve stress and fatigue due to bending and unbending as the conduit is advanced and retracted from the well.

While certain embodiments and features of the invention have been described in detail herein, it will be readily understood that the invention encompasses all modifications and enhancements within the scope and spirit of the following claims.

What is claimed is:

1. A guide system for bending conduit fed from a payout spool into a well under pressure, comprising:

a. a tubular member curved approximately 120° to provide a guide path for bending the conduit, the tubular member having open opposite outer ends and an internal diameter of sufficient size to accommodate the conduit;

b. closure members for closing the open opposite ends of the tube around the outer perimeter of the conduit; and c. a pressure supply for pressurizing the interior of the tubular member.

2. The guide system of claim 1 wherein the pressure supply is adapted for introducing well pressure into the interior of the tubular member.

3. The guide system of claim 1 wherein the pressure supply is adapted for producing an independent source of pressure for pressurizing the interior of the tubular member.

4. The guide system 1, further comprising a mounting flange secured to each outer end of the tubular member.

5. The guide system of claim 4, further including a stripper mounted on at least one of the mounting flanges for sealing the perimeter of the conduit as it is introduced into the tubular member.

6. The guide system of claim 4, further including an injection head assembly including a mounting flange, and wherein one said tubing member flanges is adapted to be mounted directly on the mounting flange of the injection head.

7. The guide system of claim 1, further including a cross brace positioned between the outer reaches of the curved tubular member for supporting same.

8. The guide system of claim 6, further including a support leg secured to the tubular member and having a lower end which may be secured directly to the injection head assembly.

9. The guide system of claim 1, wherein the tubular member is constructed of 4140 seamless steel tubing heat treated to 100 KSI yield strength.

10. A guide system for bending flexible conduit fed from a payout spool into a well under pressure, comprising:

a. a tubular member bent along a radius to provide a guide path for bending the conduit, the tubular member having open opposite outer ends and an internal diameter of sufficient size to accommodate the conduit;

b. closure members for closing the open opposite end of the tube around an outer perimeter of the conduit;

c. a pressure supply for pressurizing the interior of the tubular member; and d. at least one guide sleeve mounted in the tubular member, having an outer diameter slightly less than the inner diameter of the tube and having an inner diameter opening slightly larger than the outer diameter of the flexible conduit.

11. The guide system of claim 10, further including a plurality of guide sleeves mounted in series in end-to-end relationship inside the tubular member.

12. The guide of claim 11, wherein each sleeve is of an overall length equal approximately to its out diameter.

13. The guide system of claim 11, wherein each sleeve includes outer ends which are internally chamfered.

14. The guide system of claim 11, wherein each sleeve is formed of a high strength, low friction resin.

15. The guide system of claim 14, wherein each sleeve is formed of an HMW polyethylene.

16. The guide system of claim 11, wherein the outer diameter of each sleeve is approximately 0.25 inches smaller than the inner diameter of the tubular member.

17. The guide system of claim 11 wherein the inner diameter of each sleeve is approximately 0.25 inches larger than the outer diameter of the conduit.

18. A guide system for bending a conduit fed from a payout spool into a well under pressure, comprising:

a. a tubular member bent along a radius to provide a guide path for bending the conduit, the tubular member having open opposite outer ends and an internal diameter of sufficient size to accommodate the conduit;

b. closure members for closing the open opposite ends of the tube around the outer perimeter of the conduit;

c. means for pressurizing the interior of the tubular member; and d. a guide sleeve mounted inside the tubular member, having an outer diameter slightly less than the inner diameter of the tube and having an inner diameter opening slightly larger than the outer diameter of the flexible conduit.

19. The guide system of claim 18, further including a plurality of guide sleeves mounted in series in end-to-end relationship inside the tubular member.

20. A guide system for bending flexible conduit fed from a spool into a well under pressure, comprising:

a. a tube bent to provide a guide path for bending conduit, the tube having at least one interior guide sleeve, having open ends, and having an internal diameter of sufficient size to accommodate the conduit;

b. the guide sleeve having an outer diameter slightly less than the inner diameter of the tube, and having an inner diameter opening slightly larger than the outer diameter of the flexible conduit;

c. closure members form closing the open ends of the tube around the outer perimeter of the conduit; and d. a pressure supply for pressurizing the interior of the tube.

21. A combination for use in injecting pipe from a spool into a well, comprising:

a pipe injector located between the spool and the well;

a housing located between the spool and the injector and defining a pressure chamber structured to sealingly pass through and to bend a section of the pipe; and means for pressurizing the chamber.

22. The combination of claim 21 wherein injector is structured to impart an injecting force to a surface portion of a straight section of pipe.

23. The combination of claim 22 wherein the pressurizing means pressurizes the chamber to value different from a pressure upon a portion of exterior pipe surface receiving an injecting force.

24. The combination of claim 21 wherein the pressure chamber includes structure to bend a section of pipe approximately 120°.

25. The combination of claim 21 wherein the housing defining the pressure chamber and the pipe injector are located such that the pipe passes through the pressure chamber prior to receiving an injecting force from said injector.

26. A combination for use in injecting pipe from a spool into a well, comprising:

a pipe injector applying an injecting force to a portion of exterior pipe surface;

a housing located between the spool and the well and defining at least a portion of a pressure chamber structured to sealingly pass through pipe, the housing structured to bend a section of pipe;

means for pressuring the chamber to a value different form a pressure upon a portion of exterior pipe surface receiving an injecting force from said injector; and wherein the pipe injector is sized and structured to apply an injecting force on pipe having an OD of at least one half inch and which pipe defines a fluid conduit within.

27. The combination of claim 26 wherein the pressurizing means pressures the chamber to a value above the pressure upon a portion of exterior pipe surface receiving an injecting force.

28. The combination of claim 26 wherein a portion of exterior pipe surface receiving an injecting force is subject to atmospheric pressure.

29. The combination of claim 26 wherein the pressure chamber includes structure to bend a section of pipe approximately 120°.

30. The combination of claim 26 wherein the pipe injector is structured to impart an injecting force outside of the pressure chamber.

31. A combination for use in injecting pipe from a spool into a well, comprising:

a pipe injector operating upon an exterior surface of the pipe;

a housing located between the spool and the well defining at least a portion of a pressure chamber structured to sealingly pass through pipe, the housing structured to bend a section of pipe approximately 120°.

means for pressurizing the chamber;

wherein the pipe injector is sized and structured to apply an injecting force on pipe having an OD of at least one half inch and which pipe defines a fluid conduit within;

and wherein the pipe injector is structured to impart an injecting force outside of the pressure chamber.

32. The combination of claim 31 wherein the means for pressurizing the chamber pressurizes the chamber to a level different form well pressure.

33. A combination for use in injecting pipe from a spool into a well, comprising:

a housing defining at least a portion of a pressure chamber structured to sealingly pass through pipe, the housing structured to bend a section of pipe;

a pipe injector located to impart an injecting force to a portion of the pipe outside of the pressure chamber;

means for pressurizing the chamber;

wherein the pipe injector is sized and structured to apply an injecting force on pipe having an OD of at least on half inch and which pipe defines a fluid conduit within.

34. A method for injecting pipe from a spool into a well, comprising:

passing pipe from a spool through a pressure chamber;

bending the pipe within the pressure chamber; and imparting an injecting force to a section of the pipe subsequent to passing through the pressure chamber and prior to entering the well.

35. The method of claim 34 wherein the injecting force is imparted to an exterior surface portion of a straight section of the pipe.

36. A method for injecting pipe from a spool into a well, comprising:

passing pipe through a pressure chamber;

bending the pipe within the pressure chamber;

applying an injecting force to a surface portion of the pipe; and pressurizing the chamber to a level different from a pressure operating upon a portion of pipe surface receiving the injecting force.

37. A method for injecting pipe from a spool into a well, comprising:

passing pipe through a pressure chamber located between the spool and the well;

bending a section of pipe within the pressure chamber approximately 120°; and injecting the pipe into the well by applying an injecting force to a portion of exterior surface of the pipe subsequent to bending.

38. A method for injecting pipe from a spool into a well, comprising:

passing pipe through a pressure chamber;

bending a section of the pipe within the pressurized chamber; and applying an injecting force to the pipe between the spool and the well and outside of the pressure chamber.

* * * * *

UNITED STATES PATENT AND TRADEMARK OFFICE

CERTIFICATE OF CORRECTION

PATENT NO. : 6,006,839 
DATED : December 28, 1999
INVENTOR(S) : Michael Patrick Dearing and Michael Lee Smith It is certified that error appears in the above-identified patent and that said Letters Patent is hereby corrected as shown below:

Title page,
Item [73], should read -- [73] Assignee: Stewart & Stevenson Services, Inc. --

Signed and Sealed this

Third Day of June, 2003

JAMES E. ROGAN
*Director of the United States Patent and Trademark Office*